US009934732B2

(12) United States Patent
Lin et al.

(10) Patent No.: US 9,934,732 B2
(45) Date of Patent: Apr. 3, 2018

(54) DISPLAY METHOD AND DISPLAY DEVICE

(71) Applicant: AU OPTRONICS CORPORATION, Hsin-chu (TW)

(72) Inventors: Fang-Cheng Lin, Hsin-chu (TW); Kai-Tung Teng, Hsin-chu (TW); Chi-Wen Chang, Hsin-chu (TW); Yi-Pai Huang, Hsin-chu (TW); Han-Ping D. Shieh, Hsin-chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 10 days.

(21) Appl. No.: 15/274,514

(22) Filed: Sep. 23, 2016

(65) Prior Publication Data

US 2017/0154584 A1 Jun. 1, 2017

(30) Foreign Application Priority Data

Nov. 30, 2015 (TW) ..... 104140086 A

(51) Int. Cl.

| | |
|---|---|
| ***G09G 5/10*** | (2006.01) |
| ***G09G 3/34*** | (2006.01) |
| ***G09G 3/20*** | (2006.01) |
| ***G09G 3/36*** | (2006.01) |

(52) U.S. Cl.

CPC ..... *G09G 3/3413* (2013.01); *G09G 3/2003* (2013.01); *G09G 3/2077* (2013.01); *G09G 3/342* (2013.01); *G09G 3/36* (2013.01); *G09G 2310/0235* (2013.01); *G09G 2320/0626* (2013.01); *G09G 2320/0646* (2013.01); *G09G 2360/16* (2013.01)

(58) Field of Classification Search

CPC .. G09G 3/20; G09G 3/34; G09G 3/36; G09G 3/342; G09G 3/2003; G09G 3/2007; G09G 3/3413; G09G 5/10; G09G 2310/0235; G09G 2320/0626; G09G 2320/0646; G09G 2360/16

See application file for complete search history.

(56) References Cited

U.S. PATENT DOCUMENTS

| | | | |
|---|---|---|---|
| 8,184,087 | B2 | 5/2012 | Lin et al. |
| 8,675,030 | B2 | 3/2014 | Doyen et al. |

(Continued)

FOREIGN PATENT DOCUMENTS

| | | | |
|---|---|---|---|
| CN | 101510397 | A | 8/2009 |
| CN | 101727845 | A | 6/2010 |
| TW | 201007680 | A | 2/2010 |

*Primary Examiner* — Joe H Cheng

(74) *Attorney, Agent, or Firm* — Tim Tingkang Xia, Esq.; Locke Lord LLP

(57) ABSTRACT

A display method and a display device are disclosed herein. The display method includes the following steps: analyzing an input image to obtain a plurality of first backlight control signals and a plurality of first liquid crystal control signals; generating image edge information associated with the input image; generating, according to the image edge information, at least one second backlight control signal and at least one target liquid crystal control signal that are associated with the image edge information; and displaying, according to the at least one second backlight control signal and the at least one target liquid crystal control signal, at least one multi-color sub-frame.

18 Claims, 7 Drawing Sheets

(56) References Cited

U.S. PATENT DOCUMENTS

| | | | | |
|---|---|---|---|---|
| 2005/0116922 | A1* | 6/2005 | Kim | G09G 3/3413 345/102 |
| 2006/0139952 | A1* | 6/2006 | Inoue | G02F 1/133603 362/613 |
| 2006/0146005 | A1* | 7/2006 | Baba | G09G 3/3233 345/102 |
| 2006/0170822 | A1* | 8/2006 | Baba | G09G 3/3406 348/500 |
| 2007/0046914 | A1 | 3/2007 | Lee | |
| 2009/0091525 | A1* | 4/2009 | Hsu | G09G 3/3406 345/88 |
| 2010/0156964 | A1* | 6/2010 | Masuda | G09G 3/342 345/691 |
| 2010/0231603 | A1 | 9/2010 | Kang | |
| 2011/0249039 | A1* | 10/2011 | Ogi | G09G 3/3426 345/690 |
| 2012/0007900 | A1 | 1/2012 | Murai et al. | |
| 2013/0050240 | A1* | 2/2013 | Nakamura | G09G 3/342 345/589 |
| 2013/0069857 | A1* | 3/2013 | Koike | G09G 3/3406 345/102 |
| 2014/0092147 | A1* | 4/2014 | Kimura | G09G 3/3426 345/690 |

* cited by examiner

Average（R）=
（100+150+160+100+
100+100+130）/ 7=120

Average（G）=
（80+80+80+80+80+80+90）/
7=70

Average（B）=
（120+110+110+120+150+
120+130）/ 7=120

R

| | | |
|---|---|---|
| 100 | 150 | 160 |
| 0 | 100 | 100 |
| 0 | 100 | 130 |

Average（R）=
（100+150+160+100+
100+100+130）/ 7=120

G

| | | |
|---|---|---|
| 80 | 80 | 0 |
| 0 | 80 | 80 |
| 0 | 80 | 90 |

Average（G）=
（80+80+80+80+80+90）/
6=82

B

| | | |
|---|---|---|
| 120 | 110 | 110 |
| 0 | 120 | 150 |
| 0 | 120 | 130 |

Average（B）=
（120+110+110+120+150+
120+130）/ 7=120

FIG. 6

DISPLAY METHOD AND DISPLAY DEVICE

CROSS-REFERENCE TO RELATED APPLICATIONS

This non-provisional application claims priority under 35 U.S.C. § 119(a) on Patent Application No. 104140086 filed in Taiwan, R.O.C. on Nov. 30, 2015, the entire contents of which are hereby incorporated by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

TECHNICAL FIELD

The present disclosure relates generally to a display method and display device, and in particular to a display method and display device for field sequential color (FSC) displays to mitigate color breakup (CBU).

BACKGROUND

With the development in technology, liquid crystal displays (LCDs) have become mainstream products of displays. An LCD typically requires the use of color filters and a large number of transistors to display colors. In order to mitigate the above problem, field sequential color (FSC) displays have been developed in the industry. However, a user perceives the phenomena of color breakup (CBU) when a pixel in an FSC display is configured to project lights of three colors to different positions on the retina of the user. The problem of CBU is particularly serious at the edge of an image.

SUMMARY

In view of this, the present disclosure proposes a display method and display device to mitigate the problems described in the background.

One aspect of the present disclosure relates to a display method. The display method comprises steps of: analyzing an input image to obtain a plurality of first backlight control signals and a plurality of first liquid crystal control signals for the input image; generating image edge information associated with the input image; generating, according to the image edge information, at least one second backlight control signal and at least one target liquid crystal control signal; and displaying, according to the at least one second backlight control signal and the at least one target liquid crystal control signal, at least one multi-color sub-frame.

One aspect of the present disclosure relates to a display device. The display device comprises a display array, a backlight module, and a controller. The controller is configured to be electrically connected to the display array and the backlight module. The controller comprises an image analyzing unit, a backlight control unit, and a liquid crystal control unit. The image analyzing unit is configured to analyze an input image to obtain a plurality of first backlight control signals and a plurality of first liquid crystal control signals for the input image, and to generate image edge information associated with the input image. The backlight control unit is configured to generate at least one second backlight control signal associated with the image edge information to control the backlight module. The liquid crystal control unit is configured to generate at least one target liquid crystal control signal associated with the image edge information to control the display array.

These and other objectives, features, and advantages of the present disclosure will become apparent from the following description of the accompanying figures.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment.

FIG. 6 illustrates a schematic view of generation of a backlight control signal for edges according to one embodiment of the present disclosure.

DETAILED DESCRIPTIONS

Figure 1:
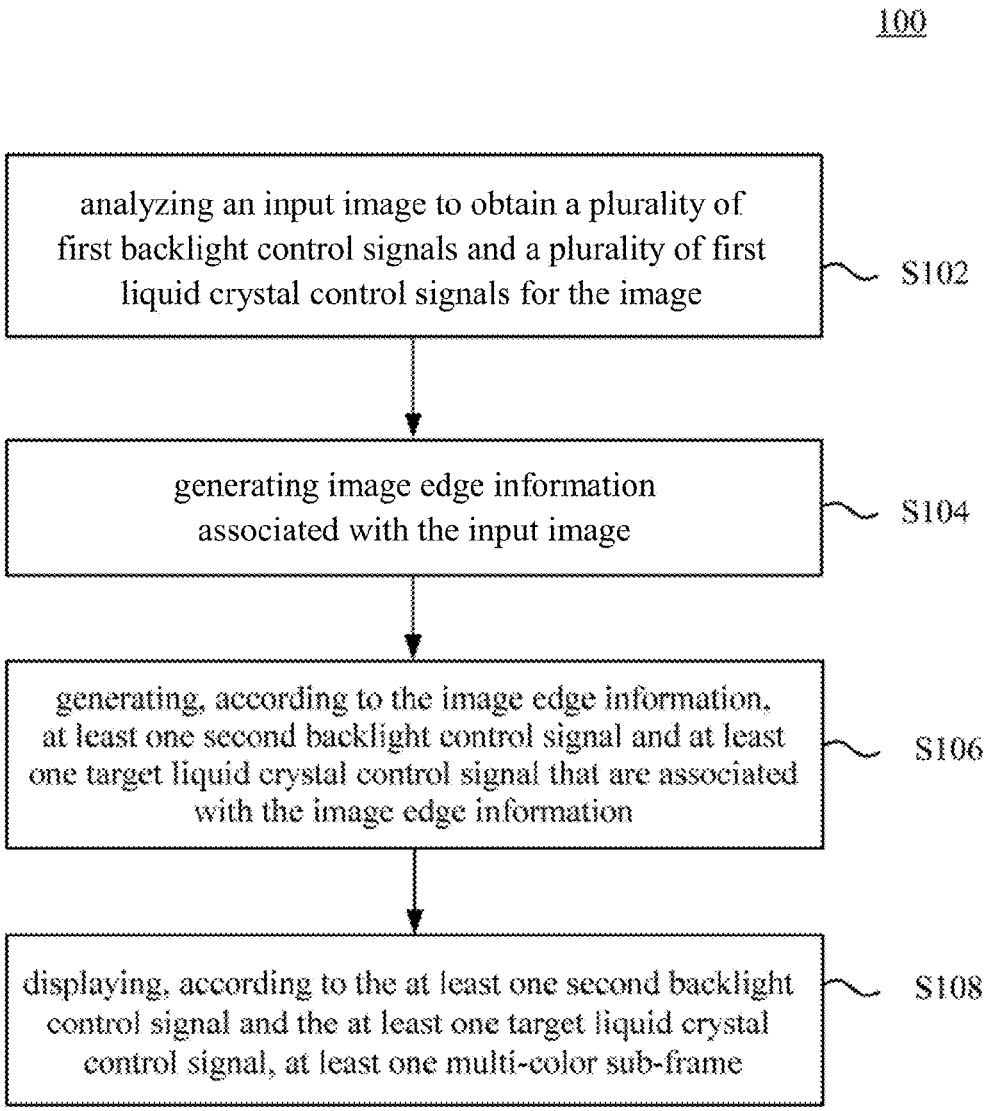
FIG. 1 illustrates a flow chart of a display method according to one embodiment of the present disclosure.

The present disclosure will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the invention or of any exemplified term. Likewise, the invention is not limited to various embodiments given in this specification.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the disclosure.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", or "includes" and/or "including" or "has" and/or "having" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom", "upper" or "top", and "left" and "right", may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper", depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Embodiments are described below in detail in conjunction with the accompanying drawings, but the provided embodiments are not intended to limit the scope of the present disclosure. The order in which the operations of a structure are described is not to be construed as a limitation, and any structure which is a rearrangement of the components and the resulting apparatus having an equivalent effect all fall within the scope of the present disclosure. In addition, the figures are merely illustrative and have not been drawn to scale. To facilitate understanding, same or similar elements in the following description are labeled by the same reference numerals.

Figure 2:
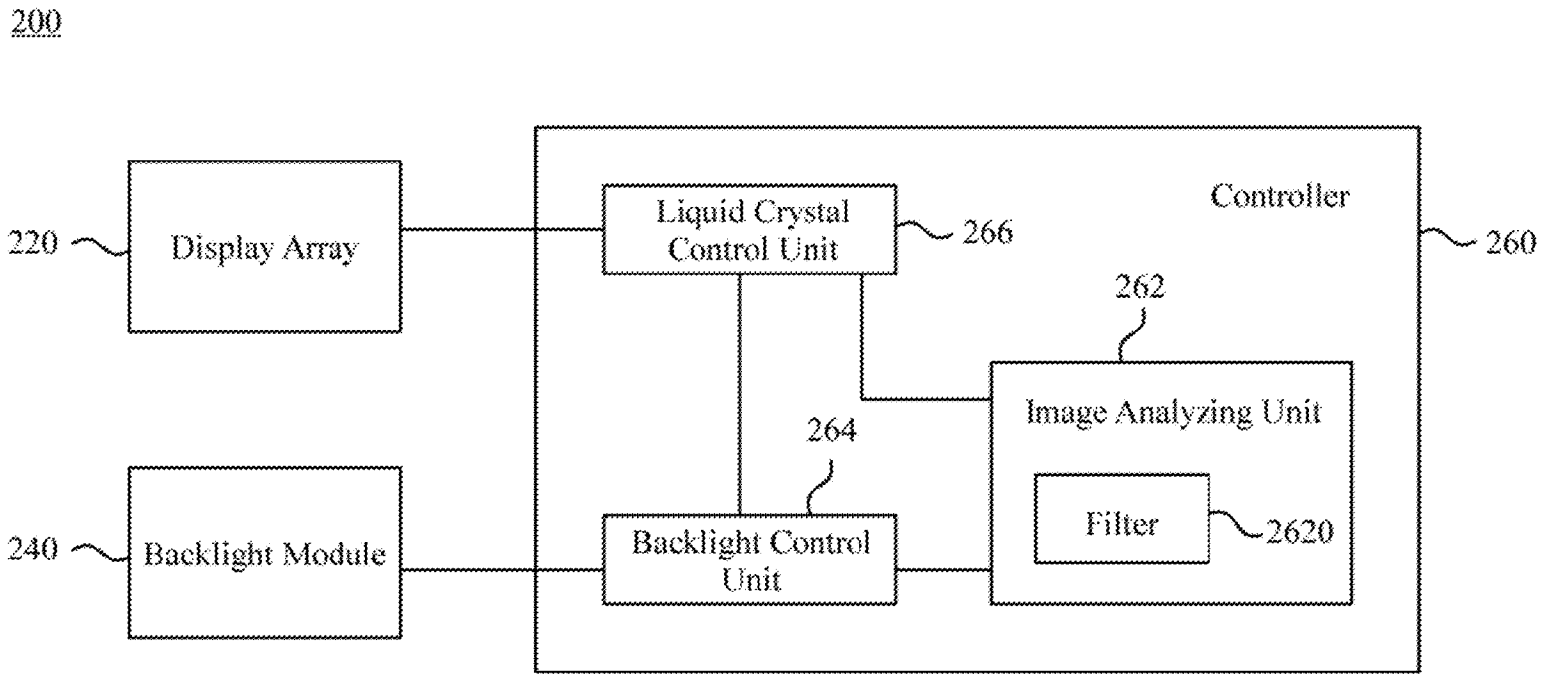
FIG. 2 illustrates a schematic view of a display device according to one embodiment of the present disclosure.

FIG. 1 illustrates a flow chart of a display method 100 according to one embodiment of the present disclosure. The display method 100 includes steps S102, S104, S106, and S108. FIG. 2 illustrates a schematic view of a display device 200 according to one embodiment of the present disclosure. In some embodiments, the display device 200 is an FSC display, and the display method 100 in FIG. 1 may be applied to the display device 200 in FIG. 2.

As shown in FIG. 2, the display device 200 includes a display array 220, a backlight module 240, and a controller 260. The display array 220 includes a plurality of pixels arranged in an array and liquid crystal units corresponding to the pixels. The backlight module 240 provides illumination for the display device 200. The controller 260 includes an image analyzing unit 262, a backlight control unit 264, and a liquid crystal control unit 266. The image analyzing unit 262 is electrically connected to the backlight control unit 264. In some embodiments, the image analyzing unit 262 includes a filter 2620. The filter 2620 may be a Sobel filter, a Laplace filter, or other components having a filtering function. In some embodiments, the image analyzing unit 262 and the filter 2620 are implemented through hardware components. In some other embodiments, the image analyzing unit 262 and the filter 2620 are implemented through software or firmware components. The backlight control unit 264 is electrically connected to the backlight module 240. The liquid crystal control unit 266 is electrically connected to the display array 220 and the backlight control unit 264. In some embodiments, the backlight control unit 264 and the liquid crystal control unit 266 are implemented through hardware components. In some other embodiments, the backlight control unit 264 and the liquid crystal control unit 266 are implemented through software or firmware components.

In some embodiments, the display device 200 is configured to display an input image. As shown in FIGS. 1 and 2, the input image is inputted to the image analyzing unit 262, and in the step S102, the image analyzing unit 262 is configured to analyze the input image to obtain a plurality of first backlight control signals and a plurality of first liquid crystal control signals corresponding to respective color lights for the input image.

Then, in the step S104, the image analyzing unit 262 is configured to generate image edge information associated with the input image. In particular, the filter 2620 in the image analyzing unit 262 can filter the input image to generate the image edge information (which may be alternatively referred to as image contour information) of the input image.

In the step S106, the backlight control unit 264 is configured to generate, according to the image edge information, at least one second backlight control signal associated with the image edge information to control the backlight brightness of the backlight module 240. The liquid crystal control unit 266 is configured to generate, according to the image edge information, at least one target liquid crystal control signal (i.e., a third liquid crystal control signal in the embodiments below) associated with the image edge information to control the liquid crystal units in the display array 220. In some embodiments, a backlight control signal with a greater signal magnitude indicates higher brightness of the backlight. In some embodiments, a liquid crystal control signal with a greater signal magnitude indicates a higher transmittance of the liquid crystal units. In the present embodiment, the magnitude of a backlight control signal or the magnitude of a liquid crystal control signal may be represented using a grayscale value. For example, if a digital backlight control signal having 8 bits is used, a maximum of the grayscale value representing the backlight control signal is 255.

In the step S108, the display device 200 is configured to display at least one multi-color sub-frame according to the second backlight control signal generated by the backlight control unit 264 and the target liquid crystal control signal (i.e., the third liquid crystal control signal in the embodiments below) generated by the liquid crystal control unit 266. In some embodiments, each multi-color sub-frame may be formed by light of at least a first color and a second color. In some other embodiments, the multi-color sub-frame may be formed by light of a first color, a second color, and a third color. The colors (i.e., the first color, the second color, and the third color) as described above may include the primary colors of red, green, and blue.

Figure 3:
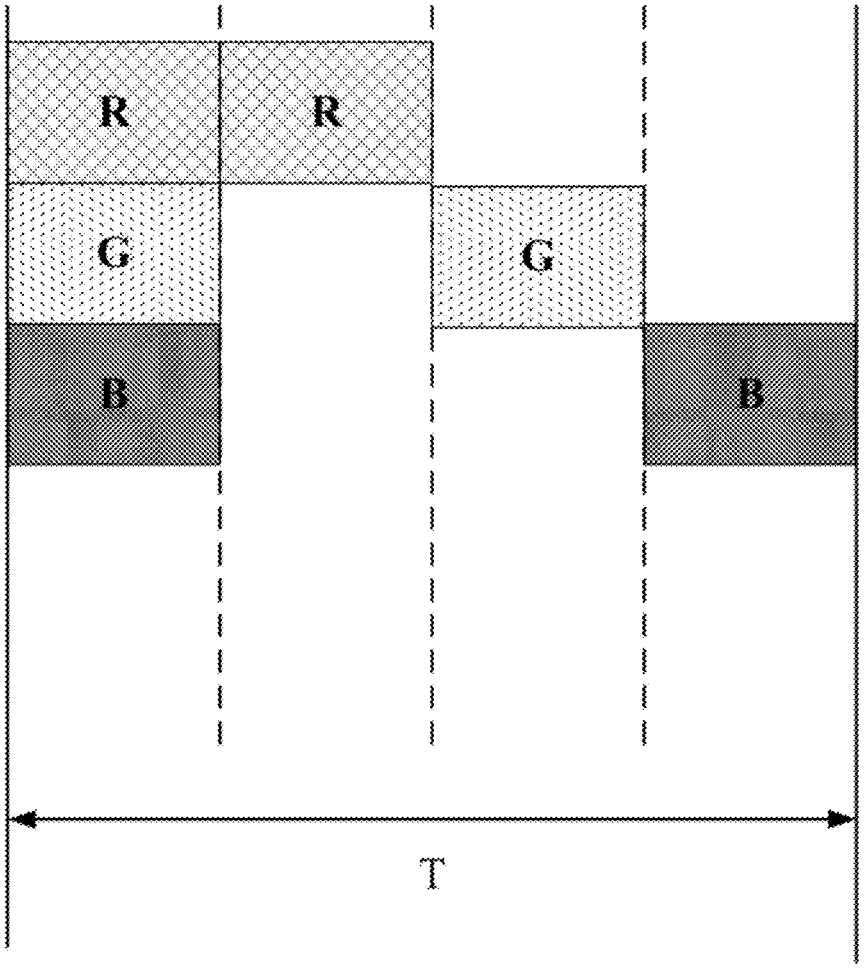
FIG. 3 illustrates a display timing diagram of the display device as shown in FIG. 2 according to one embodiment of the present disclosure.

In some embodiments, the display device 200 is further configured to display at least one single-color sub-frame according to the multi-color sub-frame in the step S108. The single-color sub-frame corresponds to light of one color. In other words, in some embodiments, the display device 200 sequentially displays a multi-color sub-frame and a single-color sub-frame during a frame period. In some embodiments, the display device 200 sequentially displays a multi-color sub-frame, a first single-color sub-frame, and a second single-color sub-frame during a frame period. In some embodiments, as shown in FIG. 3, the display device 200 sequentially displays, during a frame period T, a multi-color sub-frame, a first single-color sub-frame, a second single-color sub-frame, and a third single-color sub-frame. FIG. 3 shows a display timing diagram of the display device 200 as shown in FIG. 2 according to one embodiment of the present disclosure. As shown in FIG. 3, the multi-color sub-frame is formed by red light, green light, and blue light. The first single-color sub-frame is formed by red light, the second single-color sub-frame is formed by green light, and the third single-color sub-frame is formed by blue light. The display sequence of the multi-color and single-color sub-frames as described above is not limited to the sequence as shown in FIG. 3. In other words, the multi-color sub-frame may also be displayed between any two of the single-color sub-frames. Further, in some other embodiments, the display device 200 may display two or more multi-color sub-frames without any single-color sub-frame.

Further, in the above examples, the exemplary steps are described in a sequence, but the steps are not necessarily performed in the sequence shown. Performing the steps in different sequences may fall within the scope of the present disclosure. Additionally, the steps may be optionally added, substituted, varied in sequence, and/or omitted without departing from the spirit and scope of the embodiments of the present disclosure.

Figure 4A:
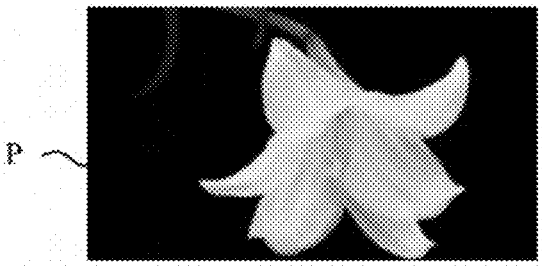
FIGS. 4A-4E illustrate schematic views of generation of a backlight control signal according to one embodiment of the present disclosure.
Figure 4B:
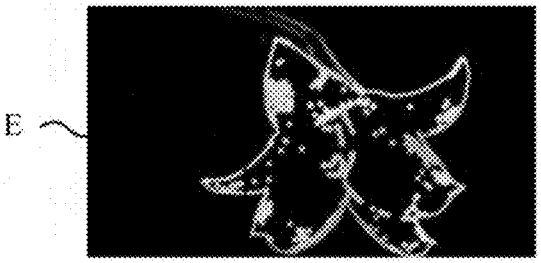

FIGS. 4A-4E illustrate schematic views of generation of a backlight control signal according to one embodiment of the present disclosure. An input image P as shown in FIG. 4A is a color image displayed by the display device 200. The input image P is inputted to the image analyzing unit 262 of the controller 260. The image analyzing unit 262 may be configured to analyze the input image P to obtain a plurality of first backlight control signals and a plurality of first liquid crystal control signals corresponding to respective color lights in each pixel of the input image P. Next, the filter 2620 of the image analyzing unit 262 may be configured to filter the input image P to generate the image edge information E (as shown in FIG. 4B) of the input image P. For example, the filter 2620 may process the input image P with a mask using the Sobel operator and select suitable pixels excluding the image at non-edges, thereby generating the image edge information E (or referred to as image contour information E) as shown in FIG. 4B.

Figure 4C:
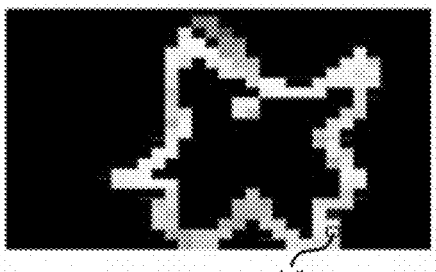
Figure 4D:
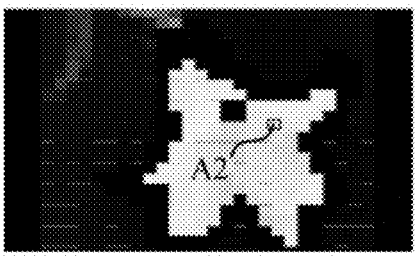

In some embodiments, the input image P may include brighter regions and darker regions, and thus can be segmented into a plurality of display blocks (e.g., a display block A1 as shown in FIG. 4C and a display block A2 as shown in FIG. 4D). Backlight control signals may be generated for each of the display blocks according to the level of brightness or darkness of each display block, such that the backlight brightness of each display block is respectively adjusted.

In some other embodiments, the input image P may be adjusted without being divided into regions. Namely, the second backlight control signal is used to adjust the backlight brightness of all of the pixels. Details of adjustment with division are described as below.

The backlight control unit 264 divides, according to the image edge information E, the plurality of display blocks in the input image P into a plurality of edge display blocks A1 (or referred to as contour display blocks A1) as shown in FIG. 4C and a plurality of non-edge display blocks A2 (or referred to as non-contour display blocks A2) as shown in FIG. 4D. Usually, the non-edge display blocks A2 refer to regions enclosed by the edge display blocks A1 and do not include the edge display blocks A1, for example, as shown in FIG. 4D. According to the plurality of first liquid crystal control signals corresponding to a color light of all of the pixels in one of the edge display blocks A1, the backlight control unit 264 generates a second backlight control signal corresponding to the color light in the edge display blocks A1. The second backlight control signal is used to control the backlight brightness of the color light of all of the pixels in the edge display block A1. In some embodiments, an average grayscale value or a maximum grayscale value of the first liquid crystal control signals may be selected as the second backlight control signal of the edge display block A1, but the present disclosure is not limited thereto. In some other embodiments, other computational methods, for example, the root mean square (RMS) method, may be used to determine the second backlight control signal.

Further, according to the plurality of first liquid crystal control signals corresponding to a color light of all of the pixels in one of the non-edge display blocks A2, the backlight control unit 264 generates a second backlight control signal corresponding to the color light in the non-edge display block A2. The second backlight control signal is used to control the backlight brightness of the color light of all of the pixels in the non-edge display block A2.

Figure 5:
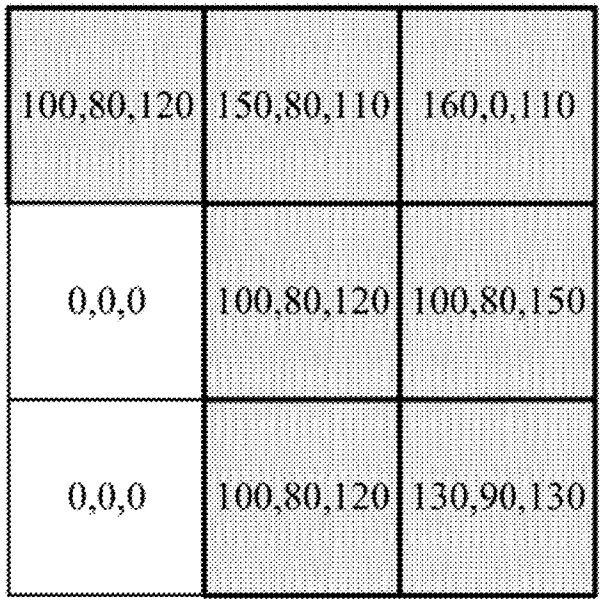
FIG. 5 illustrates a schematic view of generation of a backlight control signal for edges according to one embodiment of the present disclosure.

FIGS. 5 and 6 show schematic views of generation of a backlight control signal for edges according to one embodiment of the present disclosure. FIG. 5 shows an edge display block A1 of the input image P as shown in FIG. 4C. For example, as shown in FIG. 5, the edge display block A1 includes 9 pixels, wherein 7 pixels are colored pixels and 2 pixels are black pixels. Each of the pixels can be formed by red light, green light, and blue light. Therefore, each pixel as shown in FIG. 5 includes three first liquid crystal control signals. The three first liquid crystal control signals include a first liquid crystal control signal corresponding to red light, a first liquid crystal control signal corresponding to green light, and a first liquid crystal control signal corresponding to blue light, respectively. Using a pixel at the upper left corner as an example, the value 100 is the first liquid crystal control signal corresponding to red light, the value 80 is the first liquid crystal control signal corresponding to green light, and the value 120 is the first liquid crystal control signal corresponding to blue light.

In some embodiments, as shown in FIG. 5, if the average grayscale value of each of the first liquid crystal control signals is selected as the backlight control signal for the edges, the second backlight control signals of the edge display block A1 are (120, 70, 120). The value 120 is a second backlight control signal corresponding to red light, the value 70 is a second backlight control signal corresponding to green light, and the value 120 is a second backlight control signal corresponding to blue light.

In the computational example of the average grayscale value as shown in FIG. 5, the denominator is the number of pixels in which the first liquid crystal control signals corresponding to respective color lights are not all zeroes. In the example illustrated in FIG. 5, since the first liquid crystal control signals corresponding to respectively color lights are not all zeroes in seven pixels thereof, the denominator is 7. In particular, the value 120 of the second backlight control signal corresponding to red light is obtained by dividing the sum of the non-zero first liquid crystal control signals corresponding to red light of the nine pixels in the edge display block A1 (100+150+160+100+100+100+130) by 7. Similarly, the value 70 of the second backlight control signal corresponding to green light is obtained by dividing the sum of the non-zero first liquid crystal control signals corresponding to green light of the nine pixels in the edge display block A1 (80+80+80+80+80+90) by 7. The value 120 of the second backlight control signal corresponding to blue light is obtained by dividing the sum of the non-zero first liquid crystal control signals corresponding to blue light of the nine pixels in the edge display block A1 (120+110+110+120+150+120+130) by 7.

FIG. 6 separately shows, according to the different color lights, the first liquid crystal control signals for the edge display block A1 as shown in FIG. 5. In some embodiments, as shown in FIG. 6, the second backlight control signals of the edge display block A1 are (120, 82, 120). The value 120 is a second backlight control signal corresponding to red light, the value 82 is a second backlight control signal corresponding to green light, and the value 120 is a second backlight control signal corresponding to blue light.

In the computational example of the average grayscale value as shown in FIG. 6, the denominator is the number of pixels in which the first liquid crystal control signal corresponding to one color light is not zero. In the example illustrated in FIG. 6, the number of pixels in which the first liquid crystal control signal corresponding to red light is not zero is 7, and therefore the value 120 of the second backlight control signal corresponding to red light is obtained by dividing the sum of the non-zero first liquid crystal control signals in the nine pixels in the edge display block A1 (100+150+160+100+100+100+130) by 7. Similarly, the number of pixels in which the first liquid crystal control signal corresponding to green light is not zero is 6, and therefore the value 82 of the second backlight control signal corresponding to green light is obtained by dividing the sum of the non-zero first liquid crystal control signals in the nine pixels in the edge display block A1 (80+80+80+80+80+90) by 6. Similarly, the number of pixels in which the first liquid crystal control signal corresponding to blue light is not zero is 7, and therefore the value 120 of the second backlight control signal corresponding to blue light is obtained by dividing the sum of the non-zero first liquid crystal control signals in the nine pixels in the edge display block A1 (120+110+110+120+150+120+130) by 7.

In other words, darker backlight is used for the display blocks of lower brightness, and brighter backlight is used for the display blocks of higher brightness. As such, the power consumption of the backlight module 240 can be reduced.

In some embodiments, if a maximum grayscale value of each of the first liquid crystal control signals is selected as the second backlight control signal, the second backlight control signals of the edge display block A1 are (160, 90, 150). The value 160 is a second backlight control signal corresponding to red light, the value 90 is a second backlight control signal corresponding to green light, and the value 150 is a second backlight control signal corresponding to blue light. Referring to FIG. 6, the value 160 is a maximum grayscale level of the first liquid crystal control signal corresponding to red light in the block A1, the value 90 is a maximum grayscale level of the first liquid crystal control signal corresponding to green light in the block A1, and the value 150 is a maximum grayscale level of the first liquid crystal control signal corresponding to blue light in the block A1.

Figure 4E:
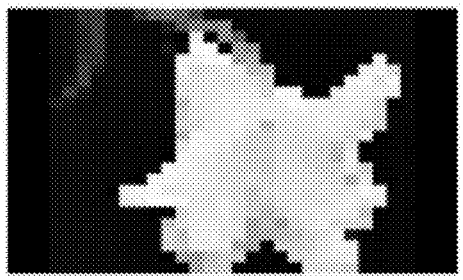

The backlight brightness of all of the edge display blocks A1 and the backlight brightness of all of the non-edge display blocks A2 can be adjusted using the methods as described above. FIG. 4C shows all of the edge display blocks, the backlight brightness of which is adjusted according to the corresponding second backlight control signals. FIG. 4D shows all of the non-edge display blocks, the backlight brightness of which is adjusted according to the corresponding second backlight control signals. FIG. 4E shows all of the edge display blocks as shown in FIG. 4C and all of the non-edge display blocks as shown in FIG. 4D; namely, the pattern shown in FIG. 4E is formed by all of the edge display blocks as shown in FIG. 4C and all of the non-edge display blocks as shown in FIG. 4D. In other words, the second backlight control signals corresponding to the edge display blocks and the second backlight control signals corresponding to the non-edge display blocks are all included in FIG. 4E.

After a backlight control signal of a display block is adjusted to be a second backlight control signal, a first liquid crystal control signal corresponding to a color light of each pixel in this display block can be adjusted to become a second liquid crystal control signal (compensating liquid crystal control signal) for liquid crystal compensation, according to the following equation (1):

$$LC2LC1\times(BL1/BL2)^{1/r} \quad (1)$$

where LC1 is the first liquid crystal control signal, LC2 is the second liquid crystal control signal, BL1 is the first backlight control signal, BL2 is the second backlight control signal, and r is a gamma factor. In practical applications, the gamma factor may be adjusted depending on the actual requirements of the display device.

Next, a third liquid crystal control signal of each pixel in this display block is generated. In some embodiments, the third liquid crystal control signal of each pixel in this display block is a minimum grayscale value of the second liquid crystal control signals (compensating liquid crystal signals) of the color lights in each pixel. For example, if the second liquid crystal control signals of a pixel are (180, 170, 60), the third liquid crystal control signal of the pixel is 60. In some other embodiments, the third liquid crystal control signal of each pixel in a display block may be less than or greater than the minimum grayscale value of the compensating liquid crystal signals (the second liquid crystal control signals) of the color lights in each pixel, but the present disclosure is not limited thereto.

Next, the display device 200 displays the edge display blocks in a multi-color sub-frame according to the second backlight control signals of a plurality of edge display blocks and the third liquid crystal control signals of the edge display blocks. Meanwhile, the display device 200 displays the non-edge display blocks in the multi-color sub-frame according to the second backlight control signals of a plurality of non-edge display blocks and the third liquid crystal control signals of the non-edge display blocks.

Since the multi-color sub-frame is displayed according to the at least one second backlight control signal and the at least one third liquid crystal control signal (target liquid crystal control signal) that are associated with the image edge information E, the image at the edge (or referred to as contour) of the input image P is collectively displayed in the multi-color sub-frame. In other words, displaying the image at the edge of the input image P in each single-color sub-frame is avoided. As such, the CBU problem at the edge of the input image can be effectively solved.

In some embodiments, after the multi-color sub-frame is displayed, at least one single-color sub-frame is displayed. Since most colors have been displayed in the multi-color sub-frame, missing colors in the multi-color sub-frame can be complemented by displaying the single-color sub-frame. In some other embodiments, the single-color sub-frames may be displayed first. After the single-color sub-frames are displayed, the multi-color sub-frame(s) may then be displayed.

In some embodiments, after the multi-color sub-frame is displayed, a first single-color sub-frame, a second single-color sub-frame, and a third single-color sub-frame are sequentially displayed. In the example illustrated in FIG. 3, the first single-color sub-frame is in red light, the second single-color sub-frame is in green light, and the third single-color sub-frame is in blue light. Further, in some other embodiments, the multi-color sub-frame may also be displayed between any two of the single-color sub-frames. Moreover, in some other embodiments, two or more multi-color sub-frames may be displayed without any single-color sub-frame.

Figure 7:
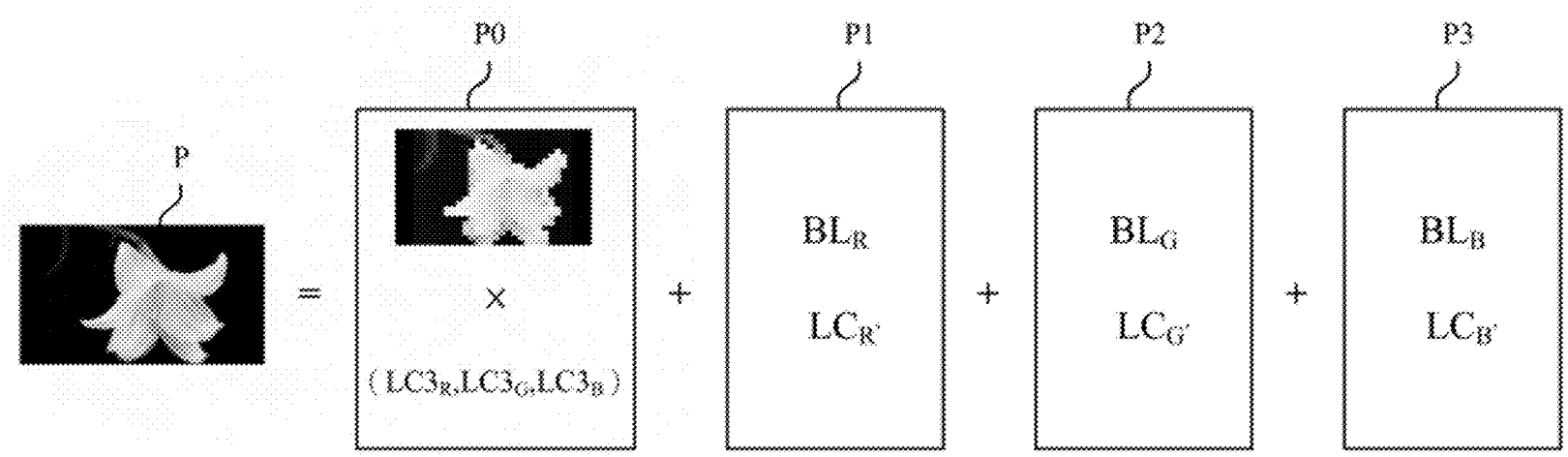
FIG. 7 illustrates a schematic view of the relationships between an input image and sub-frames according to one embodiment of the present disclosure.

FIG. 7 shows a schematic view of the relationships between an input image P and sub-frames according to one embodiment of the present disclosure. As shown in FIG. 7, the input image P is displayed in a multi-color sub-frame P0, a first single-color sub-frame P1, a second single-color sub-frame P2, and a third single-color sub-frame P3. In other words, after the multi-color sub-frame P0 is subtracted from the input image P, the remaining portions are complemented by the first single-color sub-frame P1, the second single-color sub-frame P2, and the third single-color sub-frame P3. Human eyes receive the multi-color sub-frame, the first single-color sub-frame, the second single-color sub-frame, and the third single-color sub-frame during a frame period, such that a full color image is formed thought the vision of human eyes. This color image is the input image P.

In some embodiments, the first single-color sub-frame P1 is displayed according to a second backlight control signal BLR and a first single-color liquid crystal control signal LCR' that correspond to red light. The first single-color liquid crystal control signal LCR' of each pixel is the difference between a second liquid crystal control signal LC2 corresponding to red light in each pixel and a third liquid crystal control signal LC3 of each pixel, i.e., (LC2-LC3). In some embodiments, the first single-color liquid crystal control signal LCR' is not limited to be the difference as described above. Similarly, the second single-color sub-frame is displayed according to a second backlight control signal BLG corresponding to green light and a second single-color liquid crystal control signal LCG'. The second single-color liquid crystal control signal LCG' of each pixel is the difference between a second liquid crystal control signal corresponding to green light in each pixel and a third liquid crystal control signal of each pixel. Similarly, the third single-color sub-frame is displayed according to a second backlight control signal BLB corresponding to blue light and a third single-color liquid crystal control signal LCB'. The third single-color liquid crystal control signal LCB' of each pixel is the difference between a second liquid crystal control signal corresponding to blue light in each pixel and a third liquid crystal control signal of each pixel.

Further, in some embodiments, the multi-color sub-frame may be formed by light of only a first color and a second color. For example, when the first color is red and the second color is green, the multi-color sub-frame is a yellow frame. When the first color is green and the second color is blue, the multi-color sub-frame is a cyan frame. When the first color is red and the second color is blue, the multi-color sub-frame is a magenta frame.

In some embodiments, the input image P may be adjusted without being divided into regions. Namely, the input image P is not divided into edge display blocks and non-edge display blocks. The display device 200 displays the multi-color sub-frame directly according to the image edge information E. In other words, the backlight control signals of the multi-color sub-frame are directly determined by the pixels at the edge of the input image P. As such, computational load can be significantly reduced.

To sum up, by applying one of the above embodiments in the present embodiment, the multi-color sub-frame is displayed according to the at least one second backlight control signal and the at least one target liquid crystal control signal that are associated with the image edge information. As such, the image at the edge is collectively displayed in the multi-color sub-frame, to mitigate the problem of CBU at the edge in the image.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A display method, comprising:

analyzing an input image to obtain a plurality of first backlight control signals and a plurality of first liquid crystal control signals for the input image;

generating an image edge information associated with the input image;

generating, according to the image edge information, at least one second backlight control signal and at least one target liquid crystal control signal; and displaying, according to the at least one second backlight control signal and the at least one target liquid crystal control signal, at least one multi-color sub-frame.

2. The display method of claim 1, wherein the step of generating the image edge information comprises:

filtering the input image to generate the image edge information.

3. The display method of claim 2, wherein the step of generating the at least one second backlight control signal comprises:

segmenting the input image into a plurality of display blocks that are divided into edge display blocks and non-edge display blocks according to the edge information;

generating, according to the first liquid crystal control signals in each of the edge display blocks, the at least one second backlight control signal corresponding to respective color lights in each of the edge display blocks; and generating, according to the first liquid crystal control signals in each of the non-edge display blocks, the at least one second backlight control signal corresponding to respective color lights in each of the non-edge display blocks.

4. The display method of claim 3, wherein the at least one second backlight control signal is associated with an average grayscale value of the first liquid crystal control signals, a maximum grayscale value of the first liquid crystal control signals, or a grayscale value generated by processing the first liquid crystal control signals using a root mean square method.

5. The display method of claim 4, wherein the step of generating the at least one target liquid crystal control signal comprises:

compensating, according to the at least one second backlight control signal, the first liquid crystal control signals to generate a plurality of second liquid crystal control signals; and generating, according to the plurality of second liquid crystal control signals, the at least one target liquid crystal control signal.

6. The display method of claim 5, further comprising:

displaying, according to the at least one second backlight control signal corresponding to one color light in the input image, at least one single-color sub-frame.

7. The display method of claim 1, wherein the step of generating the at least one second backlight control signal comprises:

segmenting the input image into a plurality of display blocks that are divided into edge display blocks and non-edge display blocks according to the edge information;

generating, according to the first liquid crystal control signals in each of the edge display blocks, the at least one second backlight control signal corresponding to respective color lights in each of the edge display blocks; and generating, according to the first liquid crystal control signals in each of the non-edge display blocks, the at least one second backlight control signal corresponding to respective color lights in each of the non-edge display blocks.

8. The display method of claim 1, wherein the at least one second backlight control signal is associated with an average grayscale value of the first liquid crystal control signals, a maximum grayscale value of the first liquid crystal control signals, or a grayscale value generated by processing the first liquid crystal control signals using a root mean square method.

9. The display method of claim 1, wherein the step of generating the at least one target liquid crystal control signal comprises:

compensating, according to the at least one second backlight control signal, the first liquid crystal control signals to generate a plurality of second liquid crystal control signals; and generating, according to the plurality of second liquid crystal control signals, the at least one target liquid crystal control signal.

10. The display method of claim 1, further comprising:

displaying, according to the at least one second backlight control signal corresponding to one color light in the input image, at least one single-color sub-frame.

11. A display device, comprising:

a display array;

a backlight module; and a controller configured to be electrically connected to the display array and the backlight module, the controller comprising:

an image analyzing unit configured to analyze an input image to obtain a plurality of first backlight control signals and a plurality of first liquid crystal control signals for the input image, and to generate image edge information associated with the input image;

a backlight control unit configured to generate at least one second backlight control signal associated with the image edge information to control the backlight module; and a liquid crystal control unit configured to generate at least one target liquid crystal control signal associated with the image edge information to control the display array.

12. The display device of claim 11, wherein the image analyzing unit comprises a filter configured to filter the input image to generate the image edge information.

13. The display device of claim 12, wherein the at least one second backlight control signal is associated with an average grayscale value of the first liquid crystal control signals, a maximum grayscale value of the first liquid crystal control signals, or a grayscale value generated by processing the first liquid crystal control signals using a root-mean-square method.

14. The display device of claim 13, wherein the backlight control unit is configured to generate the at least one second backlight control signals corresponding to respective color lights in a plurality of edge display blocks and the at least one second backlight control signals corresponding to respective color lights in a plurality of non-edge display blocks, and to control the backlight module according to the at least one second backlight control signal.

15. The display device of claim 14, wherein the liquid crystal control unit is configured to generate a plurality of second liquid crystal control signals according to the at least one second backlight control signal, and to generate the at least one target liquid crystal control signal according to the second liquid crystal control signals.

16. The display device of claim 11, wherein the at least one second backlight control signal is associated with an average grayscale value of the first liquid crystal control signals, a maximum grayscale value of the first liquid crystal control signals, or a grayscale value generated by processing the first liquid crystal control signals using a root-mean-square method.

17. The display device of claim 11, wherein the backlight control unit is configured to generate the at least one second backlight control signals corresponding to respective color lights in a plurality of edge display blocks and the at least one second backlight control signals corresponding to respective color lights in a plurality of non-edge display blocks, and to control the backlight module according to at least one the second backlight control signals.

18. The display device of claim 11, wherein the liquid crystal control unit is configured to generate a plurality of second liquid crystal control signals according to the at least one second backlight control signal, and to generate the at least one target liquid crystal control signal according to the plurality of second liquid crystal control signals.

* * * * *